US008910713B2

(12) United States Patent
Zuklic et al.

(10) Patent No.: US 8,910,713 B2
(45) Date of Patent: Dec. 16, 2014

(54) GUN UPSET AND NO-GO SYSTEM FOR DEPLOYMENT OF PERFORATING GUN ASSEMBLIES

(75) Inventors: Stephen N. Zuklic, Humble, TX (US); Bengisu Abramsky, League City, TX (US); Garry Kaiser, Spring, TX (US); William D. Myers, Jr., Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 278 days.

(21) Appl. No.: 13/555,102

(22) Filed: Jul. 21, 2012

(65) Prior Publication Data

US 2013/0020094 A1 Jan. 24, 2013

Related U.S. Application Data

(60) Provisional application No. 61/510,362, filed on Jul. 21, 2011.

(51) Int. Cl.

| | |
|---|---|
| ***E21B 43/11*** | (2006.01) |
| ***E21B 41/00*** | (2006.01) |
| ***E21B 43/119*** | (2006.01) |

(52) U.S. Cl.
CPC ..... *E21B 43/119* (2013.01); *E21B 41/0021* (2013.01)
USPC ..... 166/297; 166/55.7

(58) Field of Classification Search
CPC ..... E21B 43/11; E21B 43/119
USPC ..... 166/297, 298, 55, 55.1
See application file for complete search history.

(56) References Cited

U.S. PATENT DOCUMENTS

| | | | | |
|---|---|---|---|---|
| 7,422,067 | B2 * | 9/2008 | Fouras et al. | 166/369 |
| 2009/0090515 | A1 * | 4/2009 | Chan et al. | 166/382 |

* cited by examiner

*Primary Examiner* — William P Neuder
(74) *Attorney, Agent, or Firm* — Shawn Hunter

(57) ABSTRACT

Devices and methods for deploying perforating guns through a wellhead production assembly and into a wellbore. In particular embodiments, the invention provides devices and methods for deploying multiple perforating guns through a wellhead production assembly. In the event that the perforating gun assembly is dropped into the wellhead production assembly, a safety clamp will land upon a landing profile within a deployment riser, preventing the perforating gun assembly from falling into the wellbore.

17 Claims, 6 Drawing Sheets

GUN UPSET AND NO-GO SYSTEM FOR DEPLOYMENT OF PERFORATING GUN ASSEMBLIES

This application claims priority to U.S. Provisional Patent Application Ser. No. 61/510,362 filed Jul. 21, 2011.

BACKGROUND OF THE INVENTION

1. Field of the Invention

The invention relates generally to systems and methods for deploying and running perforating guns into a wellbore to be perforated.

2. Description of the Related Art

Perforating guns are devices that contain small shaped charges that are detonated to form perforations through wellbore casing and into a surrounding formation. The perforating guns are typically deployed through a wellhead production tree and run into the wellbore on a running string. The running string is often coiled tubing or drill pipe.

If a perforating gun is unintentionally dropped during deployment down to or through the wellhead production tree, it is problematic since the gun can damage components above or within the production tree. Conventional safety clamps are often attached to perforating guns when hanging them off at the surface during deployment or un-deployment (removal). However, these clamps are meant to land on elevators or slips at the surface. It is undesirable for the slips to land on elevators within the wellhead production assembly, as this may prevent the wellhead from being shut in by blowout preventers.

SUMMARY OF THE INVENTION

The invention provides devices and methods for deploying one or more perforating guns through a wellhead production tree and into a wellbore. In particular embodiments, the invention provides devices and methods for deploying multiple perforating guns through a wellhead production tree.

An exemplary embodiment is described wherein a wellhead production assembly is provided with a deployment riser having a no-go landing profile formed within. Mating safety clamps are provided that are shaped and sized to engage the no-go profile. The clamps are also shaped and sized to avoid landing upon or engagement with elevators, ledges or other restrictions within the wellhead production assembly. The safety clamps provide diametrical upsets that will engage the no-go profile.

Exemplary clamps used with the present invention are preferably formed to interfit with a complimentary clamp profile on the outer radial surface of a perforating gun assembly. In one embodiment, the clamp is an annular clamp formed of two generally semi-circular halves. The halves are preferably moveably secured to each other about a hinge and can be moved about the hinge between open and closed configurations. As a result the clamp can be readily emplaced around and removed from engagement with the clamp profile. Further in a described embodiment, the clamp includes a fastener that permits the clamp to be secured in engagement with the clamp profile.

The present invention also provides methods for deploying one or perforating guns down to and through a wellhead production assembly. In a described embodiment, a first perforating gun is provided which includes a gun portion and a connector portion. The first perforating gun includes a clamp profile that permits a safety clamp to be affixed to the perforating gun. A first safety clamp is secured to the first perforating gun. The first perforating gun is then hung within the upper opening of the wellhead production assembly with the first safety clamp in resting contact with a complimentary support surface.

Further according to an exemplary method of deployment, a number of perforating guns can be sequentially affixed to each other to form a perforating gun assembly which can then be deployed through the wellhead production assembly and run into the associated wellbore. In accordance with a described method, a second perforating gun is secured to the first perforating gun, and a second safety clamp is secured to the second perforating gun. Thereafter, the perforating gun assembly is picked up and the first clamp is removed from the first perforating gun. The perforating gun assembly is then lowered until the second safety clamp is in resting contact with the support surface.

If desired, a third perforating gun and third safety clamp can be affixed to the second perforating gun in the same manner as the second perforating gun was affixed to the first perforating gun. Thereafter, the perforating gun assembly is picked up and the second safety clamp is removed. The perforating gun assembly is lowered until the third safety clamp is in resting contact with the support surface. This technique may be repeated until the desired number of perforating guns is added to the perforating gun assembly. At each step of this technique, a safety clamp is provided that precludes the perforating gun assembly from dropping into the wellhead production assembly.

When the desired number of perforating guns have been incorporated into the perforating gun assembly, the running string is secured and then the final safety clamp is removed. The perforating gun assembly can then be run into the wellbore in a standard manner. De-deployment or removal of the perforating guns from the perforating gun assembly is done by essentially reversing the steps of deployment. Again, at least one safety clamp is connected to a perforating gun during each step of removal.

In the instance wherein the perforating gun assembly is dropped into the wellhead production assembly, a safety clamp provides a gun upset that will land upon the no-go landing profile in a deployment riser, thereby preventing the perforating gun assembly from being lost into the wellhead.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
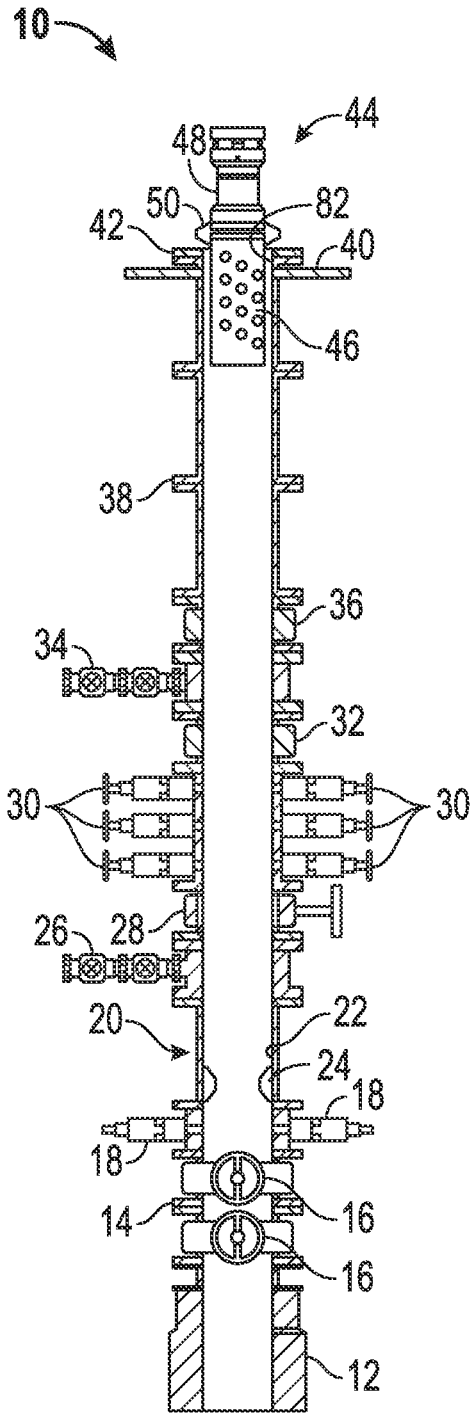
FIG. 1 is a side, cross-sectional view of an exemplary wellhead production assembly with a first perforating gun assembly disposed within the upper end.

FIGS. 1-4 depict an exemplary wellhead production assembly, generally indicated at 10, which extends upwardly from a wellhead 12. The wellhead 12 represents the entrance to a subterranean wellbore which extends downwardly through the earth to one or more hydrocarbon-bearing formations. It will be understood that the structure and assembly of components of the wellhead production assembly 10 can change as required by operational demands, and that the particular construction shown is merely an example. The exemplary wellhead production assembly 10 includes a production tree 14, of a type known in the art, having associated flow control valves 16. The production tree 14 is secured to the wellhead 12 and generally controls flow of fluids into and out of the wellhead 12. Shear/seal rams 18 are affixed to the production tree 14.

A deployment riser 20 extends upwardly from the shear/seal rams 18. The deployment riser 20 defines a central axial bore 22 (best seen in FIG. 4) with an inwardly-projecting no-go landing profile or shoulder 24. In the depicted embodiment, the no-go landing shoulder 24 is formed by an annular, inwardly-projecting flange. However, it should be understood by those of skill in the art that the no-go landing profile 24 may have other constructions. For example, one or more deployment rams might be used to provide a no-go restriction within the bore 22 that can be selectively extended into the bore 22 or retracted from the bore 22.

Located above the deployment riser 20 are a pump-in tee 26, manual valves 28, deployment blowout preventers 30, each of a type that is known in the art. A shut-in valve 32 is located above the deployment blowout preventers 30. In one embodiment, the shut-in valve 32 is hydraulically-actuated, although the valve 32 might be actuated by other methods. The shut-in valve 32 can be actuated between a normally open position and a closed position, which will close off the wellhead 12. In the depicted embodiment, an additional pump-in tee 34 and valve 36 are located above the shut-in valve 32 in the wellhead production assembly 10. Riser sections 38 extend upwardly to the rig floor 40. A support surface 42 is disposed upon or above the rig floor 40. The support surface 42 can be in the form of a C-plate or a work deck.

FIG. 1 illustrates a first perforation gun 44 which includes a gun portion 46 and a connector portion 48. The gun portion 46 may be any of a number of perforating devices that are known in the industry. The particular design and style of the perforating gun portion 44 may be dictated by downhole conditions and the operator's objectives. The connector portion 48 is preferably a quick-connect style connector that permits the perforation gun 44 to be releasably secured to another perforation gun or to a running string, such as coiled tubing. Suitable devices for use as the connector portion 48 include the SNAPSHOT™ and SNAP SCREEN™ connector arrangements, which are available commercially from Baker Hughes Incorporated of Houston, Tex.

Figure 5:
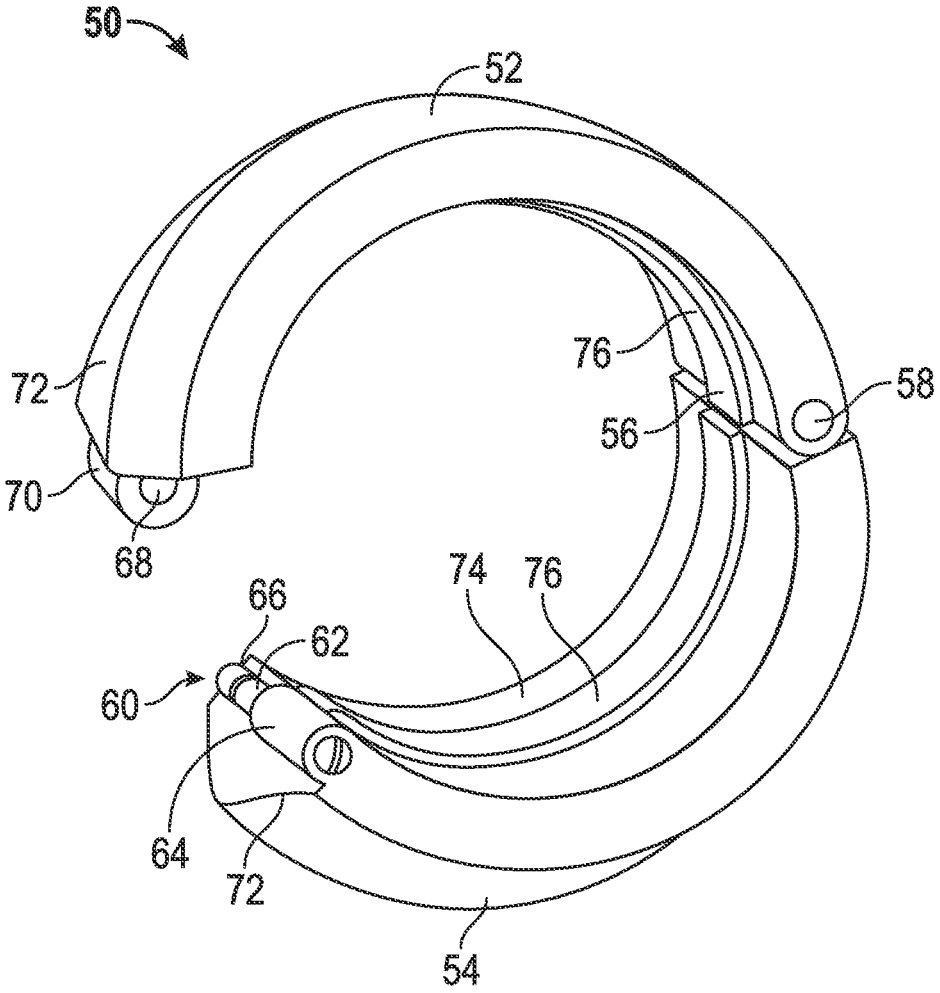
FIG. 5 is an isometric view of an exemplary safety clamp shown apart from other components.

A first safety clamp 50 is secured about the radial exterior surface of the perforating gun 44. An exemplary first safety clamp 50 is illustrated in FIG. 5. As shown there, the clamp 50 is annular and includes two generally semi-circular clamp halves 52, 54 which are moveably interconnected about hinge with hinge pin 58. The two clamp halves 52, 54 are moveable between the open position shown in FIG. 5 and a closed position (FIG. 1). In the depicted embodiment, the first safety clamp 50 is provided with a fastener, generally shown at 60. The exemplary fastener includes a spring-biased pin 62 which can be retracted into hub 64 by engagement of groove 66. The pin 62 is shaped and sized to reside within complimentary opening 68 in hub 70. Other varieties of quick fasteners may be used as well. The outer circumference of the clamp 50 presents an outwardly extending raised contact ridge 72. The interior radial surface 74 of the clamp 50 presents a raised engagement shoulder 76 that is shaped and sized to reside within a complimentary profile on the first perforating gun 44. The first safety clamp 50 may have other constructions, but is preferably constructed so as to be easily and rapidly secured to the outer radial surface of the first perforating gun 44. Once the first safety clamp 50 has been secured, the first perforating gun 44 is hung within the opening 82 of the wellhead production assembly 10 by disposing the first safety collar 50 on the support surface 42. It is further noted that the perforating gun 44, and other assemblies discussed herein, may be "picked up" and hung by means of conventional rig draw works as are known in the art.

Figure 2:
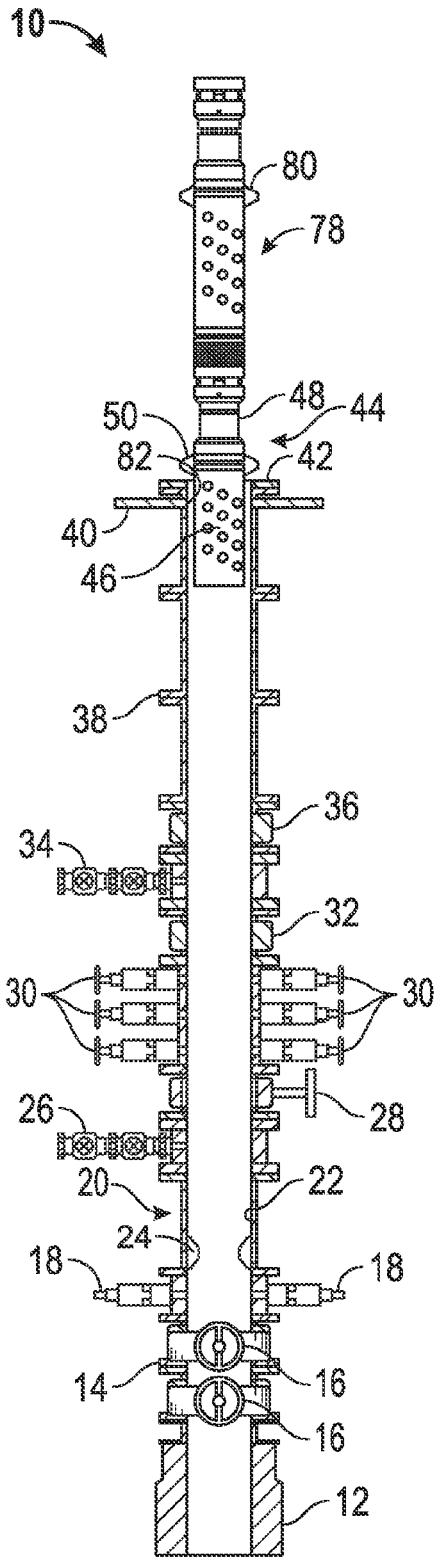
FIG. 2 is a side, cross-sectional view of the wellhead production assembly of FIG. 1, now with a second perforating gun assembly secured to the first perforating gun assembly.

FIG. 2 illustrates that a second perforating gun 78 has been secured to the connector portion 48 of the first perforating gun 44. It is noted that the second perforating gun 78 preferably has the same construction as the first perforating gun 44. A second safety clamp 80 is secured to the outer radial surface of the second perforating gun 78. The second safety clamp 80 is preferably identical in structure and function to the first safety clamp 50. When the first and second perforating guns 44, 78 are secured together, they collectively form a perforating gun assembly made up of multiple perforating guns.

Figure 3:
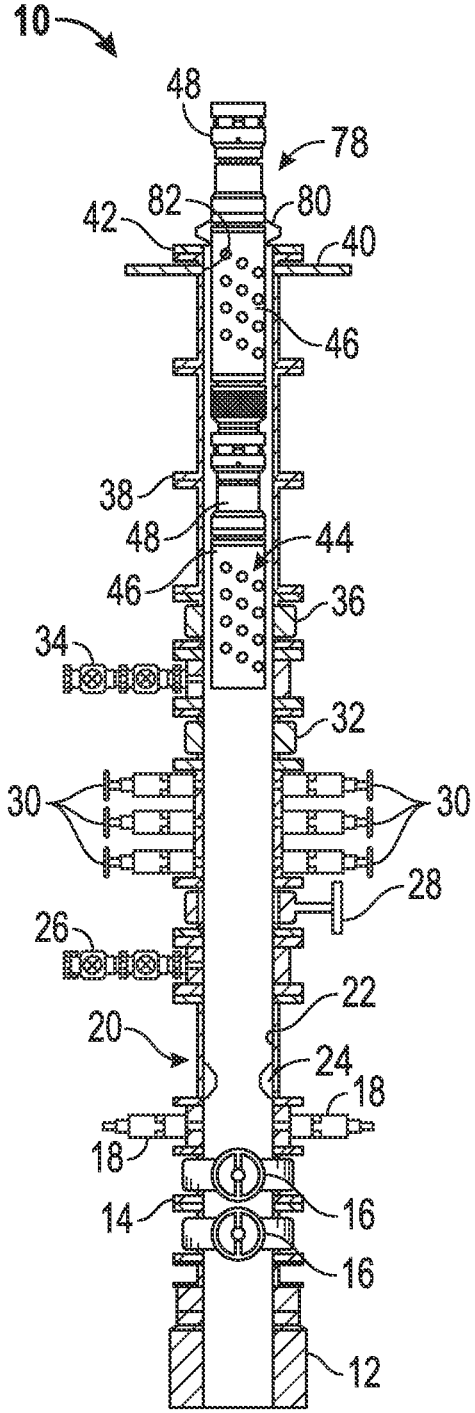
FIG. 3 is a side, cross-sectional view of the wellhead production assembly of FIGS. 1 and 2, now with the first perforating gun deployed within.

FIG. 3 depicts the next step in deploying a perforating gun assembly into the opening 82 of the wellbore production assembly 10. The perforating gun assembly is picked up from the support surface 42 and the first safety clamp 50 is removed from the first perforating gun 44. Thereafter, the perforating gun assembly is lowered into the opening 82 of the wellbore production assembly to the position shown in FIG. 3. The second safety clamp 80 is now in resting contact with the support surface 42.

It is noted that one can add a third, fourth and additional perforating guns to the perforating gun assembly by repeating the steps described above with respect to adding the second perforating gun 78 to the first perforating gun 44 and deploying the perforating gun assembly into the wellbore production assembly 10. It is further noted that, during each step of the deployment process, at least one safety clamp is secured to a perforating gun.

Figure 6:
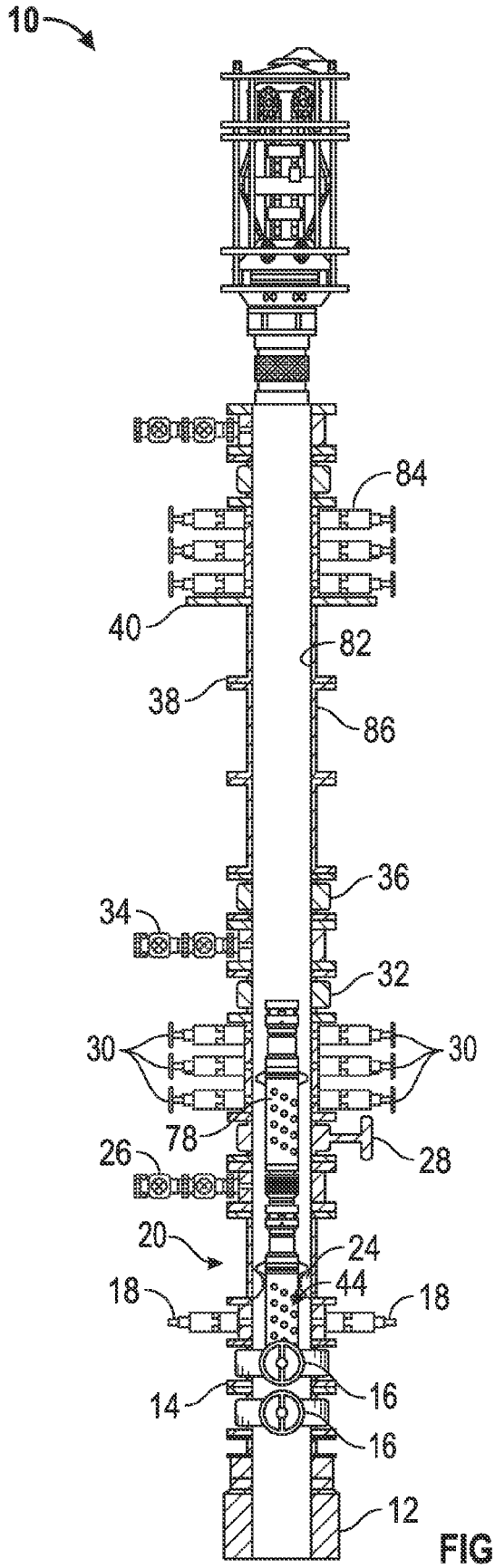
FIG. 6 is a side, cross-sectional view of the wellhead production assembly of FIGS. 1-4, now with a running string having been affixed to the perforating gun assembly.

When the desired number of perforating guns have been incorporated into the perforating gun assembly, an operator will attach a running string to the uppermost perforating gun in the perforating gun assembly. FIG. 6 depicts a coiled tubing blowout preventer stack 84 that has been picked up and supported over the entrance 82 to the wellhead production assembly 10. A coiled tubing running string 86 is then attached to the upper most perforating gun 78 in the perforating gun assembly. Thereafter, the safety clamp 80 of the final, uppermost perforating gun in the perforating gun assembly is removed, and the perforating gun assembly is then run into the wellhead production assembly 10 and the wellhead 12 in a conventional manner on the running string 86.

In order to remove and de-deploy the perforating gun assembly from the wellhead production assembly 10, the steps used in deployment are essentially reversed. The running string is removed from the wellbore, and the perforating assembly is lifted to the position shown in FIG. 3 with the uppermost perforating gun (in the described example perforating gun 78) extending out of the opening 82. A safety clamp 80 is secured around the perforating gun 78. Thereafter, the running string can be disconnected. The perforating gun assembly is then picked up to the position shown in FIG. 2, and a safety clamp 50 is secured to the next lower perforating gun (in this example, perforating gun 44). The perforating gun 78 is disconnected from the first perforating gun 44. Of course, the disconnection steps may be performed to sequentially remove and de-deploy multiple additional perforating guns.

Figure 4:
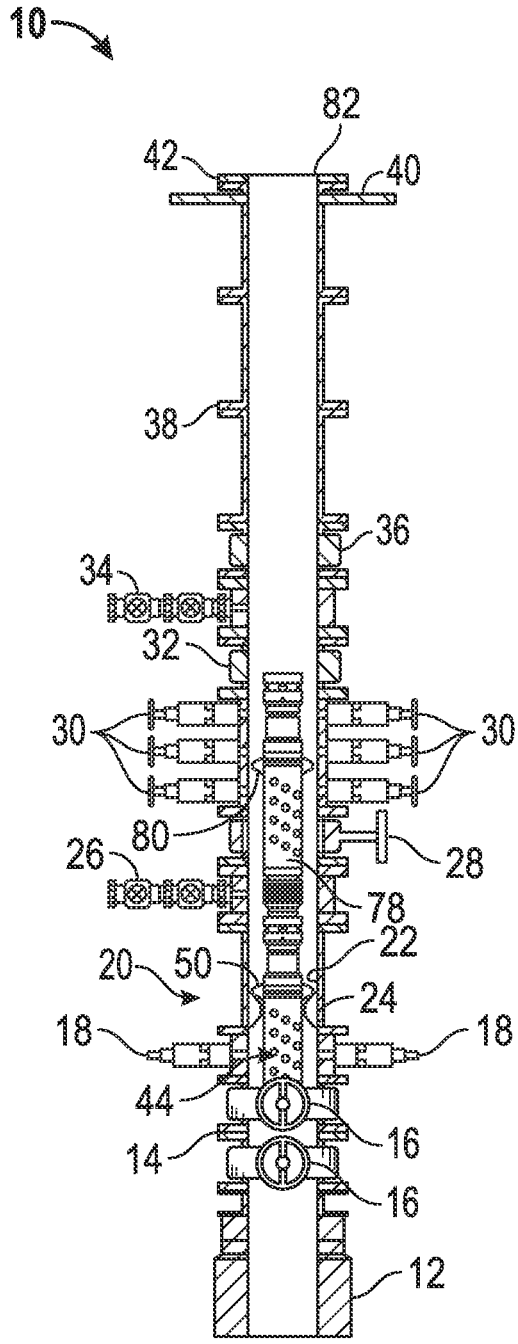
FIG. 4 is a side, cross-sectional view of the wellhead production assembly of FIGS. 1-3, now with the first and second perforating gun assemblies having been dropped within the upper end of the production assembly.

FIG. 4 illustrates the situation wherein the perforation gun assembly has been dropped into the wellhead production assembly 10. As can be seen, the first safety clamp 50 lands upon the no-go landing shoulder 24 of the deployment riser 20. The shape and size of the safety clamp 50 provides an upset for the associated perforation gun to ensure that it will land upon the no-go landing shoulder 24 only and not upon any of the components within the wellhead production assembly 10 above the deployment riser 20. The deployment riser 20 therefore prevents the perforating gun assembly from being lost within the wellhead 12. It is further noted that the deployment riser 20 is located below the shut-in valve 32, which permits the wellhead to be closed off by the valve 32 even in the event that the perforating gun assembly has fallen and landed upon the landing shoulder 24.

It is noted that the systems and methods of the present invention might be used to deploy modular devices other than perforating guns. For example, modular sand screen assemblies might be assembled and deployed through the wellhead production assembly 10 and run into the wellhead 12 on a running string.

Those of skill in the art will recognize that numerous modifications and changes may be made to the exemplary designs and embodiments described herein and that the invention is limited only by the claims that follow and any equivalents thereof.

What is claimed is:

1. A method of deploying a perforating gun assembly into a wellhead production assembly comprising the steps of:
- securing a first safety clamp to a first perforating gun;
- hanging the first perforating gun within the wellhead production assembly by resting the first safety clamp on a support surface;
- securing a second perforating gun to the first perforating gun to form a perforating gun assembly;
- securing a second safety clamp to the second perforating gun;
- removing the first safety clamp; and
- lowering the perforating gun assembly into the wellhead production assembly to rest the second safety clamp on the support surface.

2. The method of claim 1 wherein the first safety clamp comprises two generally semi-circular clamp halves which are moveably interconnected about a hinge.

3. The method of claim 1 wherein the support surface comprises a surface disposed on or above a rig floor on the wellhead production assembly.

4. The method of claim 1 further comprising the step of providing a no-go landing shoulder within the wellhead production assembly that is shaped and sized to engage a safety clamp in the event that the perforating gun assembly is dropped into the wellhead production assembly.

5. The method of claim 1 further comprising the steps of:
- securing a third perforating gun to the second perforating gun;
- securing a third safety clamp to the third perforating gun;
- removing the second safety clamp from the second perforating gun; and lowering the perforating gun assembly into the wellhead production assembly to rest the third safety clamp on the support surface.

6. The method of claim 1 further comprising the step of securing a running string to the perforating gun assembly.

7. The method of claim 6 further comprising the step of removing all safety clamps from the perforating gun assembly and running the perforating gun assembly into the wellhead production assembly using the running string.

8. The method of claim 1 wherein the first safety clamp includes a ridge to engage a complimentary profile on a perforating gun.

9. The method of claim 4 wherein the no-go landing shoulder is located below a shut-in valve of the wellhead production assembly so that the wellhead production assembly can be shut off in the event that the perforating gun assembly is dropped into the wellhead production assembly.

10. A method of deploying a perforating gun assembly into a wellhead production assembly comprising the steps of:
- disposing a no-go landing shoulder within the wellhead production assembly that is shaped and sized to engage a safety clamp in the event that the perforating gun assembly is dropped into the wellhead production assembly;
- securing a first safety clamp to a first perforating gun;
- hanging the first perforating gun within the wellhead production assembly by resting the first safety clamp on a support surface;
- securing a second perforating gun to the first perforating gun to form a perforating gun assembly;
- securing a second safety clamp to the second perforating gun;
- removing the first safety clamp; and
- lowering the perforating gun assembly into the wellhead production assembly to rest the second safety clamp on the support surface.

11. The method of claim 10 wherein the first safety clamp comprises two generally semi-circular clamp halves which are moveably interconnected about a hinge.

12. The method of claim 10 wherein the support surface comprises a surface disposed on or above a rig floor on the wellhead production assembly.

13. The method of claim 10 further comprising the steps of:
- securing a third perforating gun to the second perforating gun;
- securing a third safety clamp to the third perforating gun;
- removing the second safety clamp from the second perforating gun; and lowering the perforating gun assembly into the wellhead production assembly to rest the third safety clamp on the support surface.

14. The method of claim 10 further comprising the step of securing a coiled tubing running string to the perforating gun assembly.

15. The method of claim 14 further comprising the step of removing all safety clamps from the perforating gun assembly and running the perforating gun assembly into the wellhead production assembly using the coiled tubing running string.

16. The method of claim 10 wherein the first safety clamp includes a ridge to engage a complimentary profile on a perforating gun.

17. The method of claim 10 wherein the no-go landing shoulder is located below a shut-in valve of the wellhead production assembly so that the wellhead production assembly can be shut off in the event that the perforating gun assembly is dropped into the wellhead production assembly.

* * * * *